US006397640B1

(12) United States Patent
Williams

(10) Patent No.: US 6,397,640 B1
(45) Date of Patent: Jun. 4, 2002

(54) KNITTING NEEDLES WITH MOVABLE CABLE FOR KNITTING SMALL CIRCUMFERENTIAL AREA

(76) Inventor: Rachel M. Williams, 1000 Madison, Apt. B, Oak Park, IL (US) 60302

( * ) Notice: Subject to any disclaimer, the term of this patent is extended or adjusted under 35 U.S.C. 154(b) by 0 days.

(21) Appl. No.: 09/753,596

(22) Filed: Jan. 3, 2001

(51) Int. Cl.[7] ..... O04B 35/02
(52) U.S. Cl. ..... 66/117
(58) Field of Search ..... 66/116, 117, 1 A, 66/118

(56) References Cited

U.S. PATENT DOCUMENTS

| | | | | | |
|---|---|---|---|---|---|
| 1,313,461 | A | | 8/1919 | Brown | |
| 1,989,352 | A | | 1/1935 | Davis | |
| 2,462,473 | A | * | 2/1949 | Delaney | 66/116 |
| 2,507,174 | A | | 5/1950 | Phillips | |
| 2,633,720 | A | | 4/1953 | Robbins | |
| 3,603,115 | A | | 9/1971 | Elzey et al. | |
| 4,195,496 | A | * | 4/1980 | Vasquez et al. | 66/117 |
| 4,229,833 | A | * | 10/1980 | Cox et al. | 2/16 |
| 4,341,094 | A | | 7/1982 | Heide | |
| 4,501,133 | A | | 2/1985 | Kretzschmar et al. | |
| 4,553,410 | A | * | 11/1985 | Okada | 66/117 |
| 4,646,543 | A | | 3/1987 | Okada | |
| 4,693,094 | A | | 9/1987 | Kahn | |
| D299,562 | S | * | 1/1989 | Lee | D29/20 |
| 4,856,112 | A | * | 8/1989 | Effle | 2/59 |
| 5,143,762 | A | * | 9/1992 | Ho | 428/35 |
| 5,173,967 | A | * | 12/1992 | Carter | 2/242 |
| 5,187,813 | A | * | 2/1993 | Klein | 2/16 |
| 5,335,372 | A | * | 8/1994 | Wiedner et al. | 2/16 |
| 5,402,536 | A | * | 4/1995 | Matthews | 2/16 |
| 5,542,121 | A | * | 8/1996 | Lahaussois et al. | 2/59 |
| 5,575,014 | A | * | 11/1996 | Kane et al. | 2/239 |
| 5,628,062 | A | * | 5/1997 | Tseng | 2/16 |
| 5,638,546 | A | * | 6/1997 | Vita | 2/16 |
| 5,642,525 | A | * | 7/1997 | Ketola | 2/16 |
| 5,674,189 | A | * | 10/1997 | McDowell et al. | 602/62 |
| 5,682,616 | A | * | 11/1997 | Pisano | 2/239 |
| 5,720,187 | A | | 2/1998 | Matuo | |
| 5,734,992 | A | * | 4/1998 | Ross | 2/161.7 |
| 5,924,130 | A | * | 7/1999 | Fragomeli | 2/16 |
| 5,974,586 | A | * | 11/1999 | Reinoso | 2/16 |

* cited by examiner

*Primary Examiner*—Danny Worrell
(74) *Attorney, Agent, or Firm*—Marshall, Gerstein & Borun

(57) ABSTRACT

A circular knitting needle assembly allows for knitting of small circumferential areas of garments. The circular knitting needle assembly retains knitted loops on a flexible cable that is slidably engaged with a pair of elongated hollow knitting needles. Each of the knitting needles has an elongated channel extending substantially the entire length of the knitting needle, and an end of the flexible cable is retained within the elongated channel.

8 Claims, 2 Drawing Sheets

KNITTING NEEDLES WITH MOVABLE CABLE FOR KNITTING SMALL CIRCUMFERENTIAL AREA

BACKGROUND

1. Field of the Invention

This invention relates to knitting needles and, more specifically, to knitting needles adapted to knit small circumferential areas, such as sleeves, cuffs, socks, gloves, and hats.

2. Description of the Prior Art

A problem frequently faced by both professional and amateur knitters is the difficulty in knitting small circumferential areas, such as cuffs, socks, and gloves. Due to the geometry of conventional knitting needles, one widely-used method of knitting these circumferential areas of garments is to use multiple needles, typically four, as shown in FIG. 12 of U.S. Pat. No. 5,720,187. Multiple loops are retained on each of three needles, while the fourth needle is used to add additional loops to one of the needles. Once enough loops are added to a particular needle to form a portion of the desired curved surface, the loops are transferred to the next-adjacent needle. In this manner, the ability to minimize the curvature of the circumferential area of the garment is undesirably limited by the multiple needles used to create the curvature.

One alternative is to independently knit two flat panels, then knit the panels together along their length. This undesirably results in visible seams, which may detract from the aesthetics of the garment.

Another alternative has been to affix a flexible cable at one end of each of a pair of knitting needles. This alternative is generally known in the art as a circular knitting needle. Such a needle is shown in various patents dating back to the early 1900's, such as U.S. Pat. Nos. 1,313,461, 1,989,352, and 2,633,720. The cable retains the loops at the distal end of the needles, enabling the circumferential portions of a garment to be knitted in a more curvilinear shape. The shortcoming of this alternative has been that the lengths of the needles still limit the ability to minimize the circumferential areas to be knitted. The needles cannot be used to knit too tight a circumference, because the loops still need to travel the length of the needle to be retained on the cable.

In order to achieve smaller circumferential areas, the knitting needle can be provided with a bend as shown in U.S. Pat. Nos. 1,313,461, 2,507,174, and 5,720,187. However, even with the added curvature of the bent needles, there is still a need to knit even smaller circumferential areas than possible with the circular needle configurations. Thus, the present invention is aimed at achieving a circular needle capable of knitting smaller circumferential areas than conventional knitting methods and devices, while preserving a seamless look to finished garments.

SUMMARY OF THE INVENTION

The present invention utilizes a pair of hollow needles, each including an elongated channel therein along most of its length. The elongated channel of each needle permits a flexible cable connecting the needles to run or slide along the length of both of the needles. The cable is slidably retained in each of the needles by suitable retention means, such as a spherical member secured to each end of the cable, the spherical member having a diameter greater than the width of the channel in each of the needles, but sufficiently less than the inner diameter of the hollow needles to permit the cable to easily slide along the length of the needle.

Particular aspects of the present invention will be explained in greater derail in the following detailed description of the preferred embodiment and the accompanying drawing.

DETAILED DESCRIPTION OF THE PREFERRED EMBODIMENT

Figure 1:
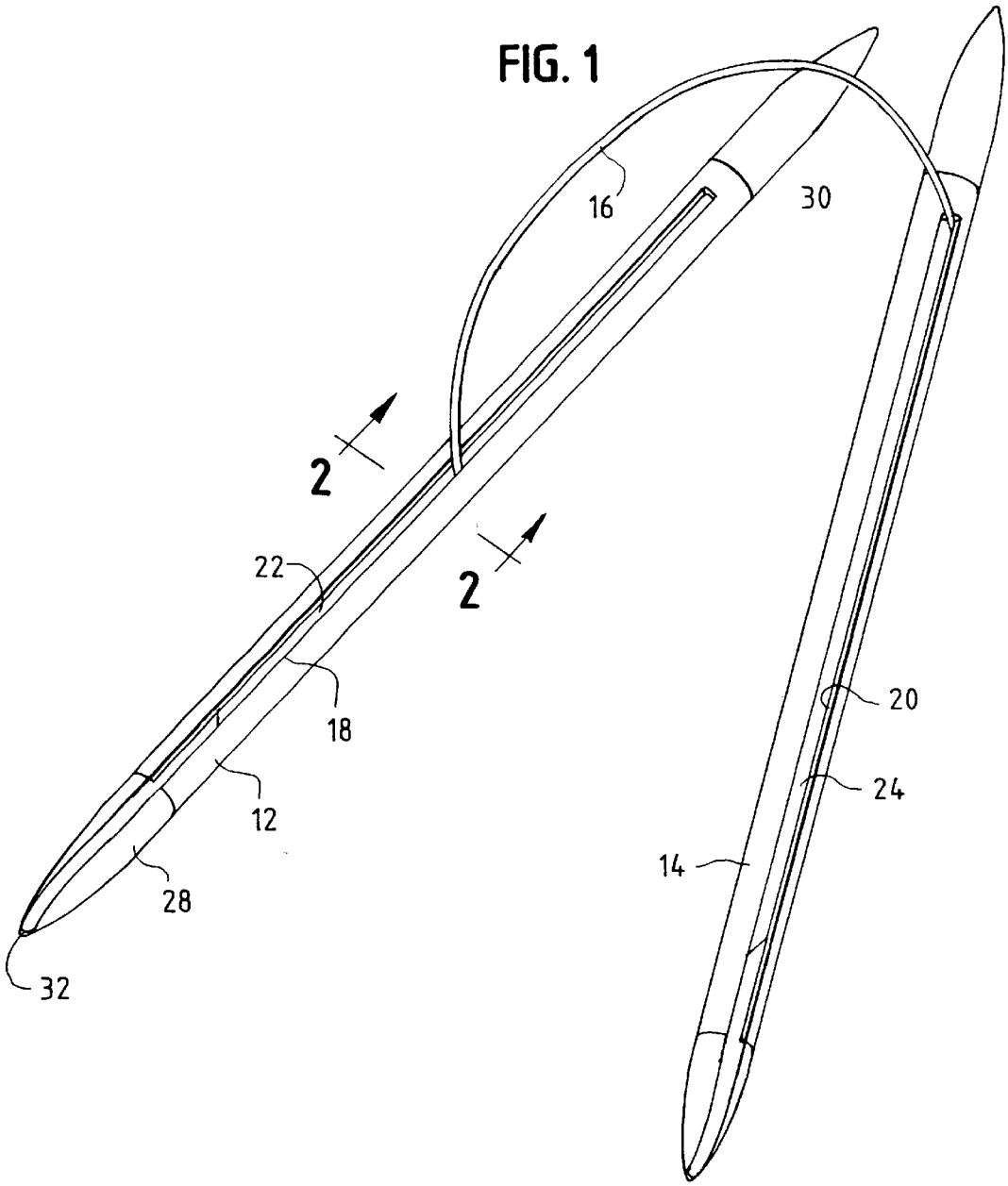
FIG. 1 is a perspective view of the circular needle of the present invention.
Figure 2:
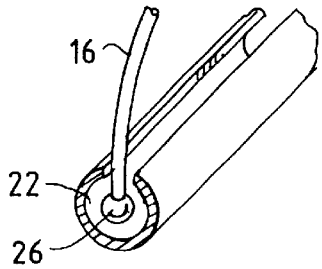
FIG. 2 is a cross-sectional view taken along lines 2—2 of FIG. 1.

Referring to FIGS. 1 and 2, the circular needle 10 of the present invention includes a pair of substantially hollow knitting needles 12, 14, and a flexible cable 16 slidably received in each of the knitting needles 12, 14. In order to slidably receive the flexible cable 16, each of the knitting needles 12, 14 is provided with an elongated channel 18, 20 extending substantially the entire length of the respective knitting needle 12, 14. A suitable retention means is also provided to retain each end of the cable within the hollow cavity 22, 24 in the knitting needles 12, 14.

As best shown in FIG. 2, one form of retention means is a spherical member 26 attached to the end of the cable 16. The spherical member 26 preferably has a diameter at least as large as the width of each of the channels 18, 20, but narrower than the inner diameter of the hollow cavities 22, 24. In this manner, the cable is securably received in each channel 18, 20, while still being able to slide along the length of each of the knitting needles 12, 14 in order to receive and retain loops of knitted material.

It may be desirable for the spherical member 26 to have a diameter larger than the width of the channels 18, 20, to provide even greater secured connection of the cable 16 to the knitting needles 12, 14. However, it is recognized that even if there is sufficient clearance for the spherical member 26 to be pulled through the channels 18, 20 of the knitting needles 12, 14, the cable 16 has a general tendency to bias the spherical members 26 toward the inner wall defining the hollow cavities 22, 24 of the knitting needles, and away from the channels 18, 20. There is some benefit to having the ability to remove the cable 16 from one or both of the knitting needles 12, 14, for example to reverse an incorrectly knitted loop or repair just a portion of a garment. By providing a spherical member 26 having a diameter about equal to the width of the channels 18, 20, a user could still manipulate the circular knitting needle assembly to remove the ends of the cable 16 by pulling the generally spherical members 26 through the channels 18, 20 when desired. Reassembly is achieved by simply reinserting the generally spherical members 26 on the ends of the cable 16 back through the respective channels 18, 20.

An alternate to the separate spherical member 26 is to heat each end of the cable 16 until the respective ends bead, to a diameter at least as wide as the width of each of the channels 18, 20 but narrower than the inner diameter of the hollow cavities 22, 24. This forms an integral, generally spherical bead member on each end of the cable 16, which advantageously retains the cable 16 within each of the respective knitting needles 12, 14.

While each of the knitting needles 12, 14 may be made of a single material, such as metal or rigid plastic, it is preferable to have tapered tips 28, 30 on each end of the knitting needles 12, 14. As seen in FIG. 1, at least one of the tips 28 has the channel 18 extend to the extreme end 32 of the tip 28. This allows for the cable 16 to lay parallel to the knitting needle 12 by running through the portion of the channel 18 that extends to the extreme end 32 of the tip 28, which facilitates transfer of loops or stitches from the knitting needle 12 to the cable 16. Such easy transfer, without the need to push the entire length of the knitting needle 12 through the stitches to transfer stitches to the cable 16 connecting the knitting needles 12 and 14 to one another, allows for continuous circular knitting of significantly smaller circumferential areas than is possible with conventional circular knitting needles.

At least one of the tapered tips 28, 30 are preferably removable, to provide a means for removing the cable 16 from the knitting needles 12, 14, particularly if the diameter of the generally spherical member 26 is wider than the width of each of the channels 18, 20.

Figure 3:
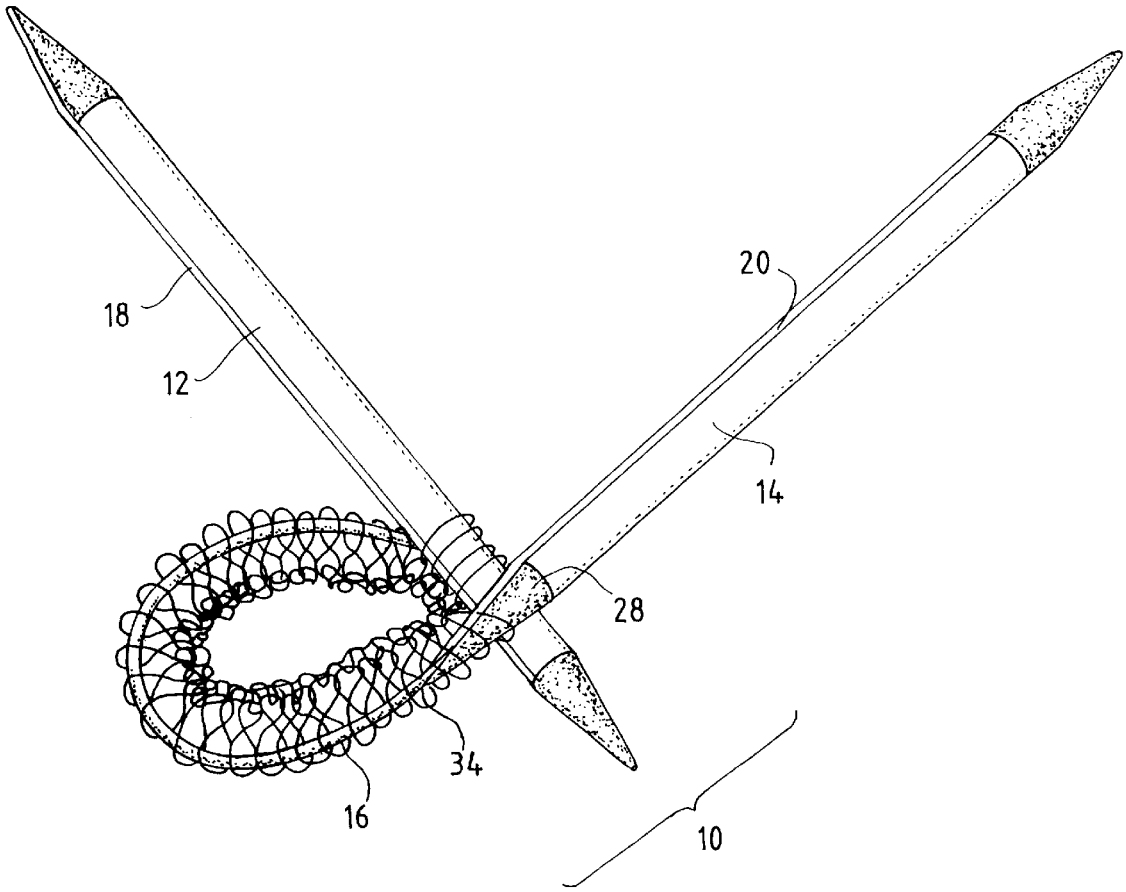
FIG. 3 is a top view of the circular needle shown in FIG. 1, with several loops of yarn retained on the cable of the circular needle.

One method of using the circular knitting needle of the present invention is as follows. First, a portion of the total number of stitches is transferred to the first knitting needle 12. Next, that portion of stitches on the first knitting needle 12 is knit. As each stitch is knitted, the user passes the knitted stitch onto the second knitting needle 14. Finally, after all the knitted stitches are collected on the second knitting needle 14, the knitting needle 14 or the cable 16 is bent so that the cable 16 lies parallel to the extreme end 34 of the tip 28 of the knitting needle 14, which is the narrowest end of the tip 28, and the knitted stitches are transferred onto the cable 16. This is best shown in FIG. 3.

The process is repeated, with more stitches transferred to the first needle, until the garment, or desired portion of the garment, is complete. Thus, one benefit of the present invention is the ability to knit an entire garment using one tool, rather than needing four or more small needles to knit circumferential areas, and a separate pair of needles to knit the rest of the garment.

The cable is preferably made of soft, bendable plastic or metal. A synthetic resin material may also be used. It is desirable for the cable to be resistant to creasing, kinking, or permanent bending. Because the length of the cable may limit the circumferential areas that can be knitted, it is desirable for one or both of the tips 28, 30 to be removable from each knitting needle 12, 14, so that the cable 16 can be easily replaced with a cable of a different length (not shown).

While the present invention has been described with respect to certain preferred embodiments thereof, it will be understood by those of ordinary skill in the art that changes can be made that are still within the scope of the appended claims.

I claim:

1. A circular knitting needle assembly comprising:

a first knitting needle and a second knitting needle, each of said first and second knitting needles having a substantially cylindrical body and an elongated channel extending substantially the length of said substantially cylindrical body;

a flexible cable connecting said first and second knitting needles to one another, said flexible cable having a first end slidably received in said elongated channel of the first knitting needle and a second end slidably received in said elongated channel of the second knitting needle.

2. The circular knitting needle assembly of claim 1, further comprising means for slidably retaining said first end of the flexible cable within the substantially cylindrical body of the first knitting needle and means for slidably retaining said second end of the flexible cable within the substantially cylindrical body of the second knitting needle.

3. The circular knitting needle assembly of claim 2, wherein each of said means for slidably retaining said ends of the flexible cable within the substantially cylindrical body of the respective knitting needle comprises a generally spherical member having a diameter at least as wide as a width of said elongated channel of the respective knitting needle and narrower than an inner diameter of said substantially cylindrical body of the respective knitting needle.

4. The circular knitting needle assembly of claim 3, wherein each of said generally spherical members comprises a beaded end of the respective end of the flexible cable.

5. The circular knitting needle assembly of claim 1, wherein each of said first and second knitting needles is provided with a pair of tapered tips, one of said tapered tips being securably received in a proximate end of said substantially cylindrical body of the knitting needle and the other of said tapered tips being securably received in a distal end of the substantially cylindrical body of the knitting needle.

6. The circular knitting needle assembly of claim 5, wherein at least one of the tapered tips of each of said first and second knitting needles has a generally hollow core and is provided with a channel coextensive with said elongated channel of the respective knitting needle, and said channel of the tapered tip terminates at a narrowest end of said tapered tip.

7. A circular knitting needle assembly comprising:

a first elongated knitting needle, a second elongated knitting needle, and a flexible cable slidably engaging each of said first and second elongated knitting needles, each of said first and second elongated knitting needles including a tapered tip at each end thereof, and wherein at least one tapered tip on each of said first and second elongated knitting needles is removable from said associated elongated knitting needle.

8. A circular knitting needle assembly comprising:

a first elongated knitting needle, a second elongated knitting needle, and a flexible cable slidably engaging each of said first and second elongated knitting needles, wherein the sliding of said flexible cable is bounded by a pair of channels, one of said channels running substantially the length of said first elongated knitting needle, and the other of said channels running substantially the length of said second elongated knitting needle.

* * * * *